United States Patent [19]

Hoffmann et al.

[11] Patent Number: 4,475,098

[45] Date of Patent: Oct. 2, 1984

[54] METHOD OF MANUFACTURING A MULTI-PHASE THERMAL CIRCUIT BREAKER AND MULTI-PHASE THERMAL CIRCUIT BREAKER PRODUCED THEREBY

[75] Inventors: Heinrich Hoffmann, Aarburg; Kurt Hänni, Buchs; Willy Feller, Rombach, all of Switzerland

[73] Assignee: Sprecher & Schuh AG, Aarau, Switzerland

[21] Appl. No.: 469,115

[22] Filed: Feb. 23, 1983

[30] Foreign Application Priority Data

Mar. 22, 1982 [CH] Switzerland ..... 1741/82

[51] Int. Cl.[3] ..... H01H 61/00; H01H 71/16

[52] U.S. Cl. ..... 337/49; 337/46; 29/622

[58] Field of Search ..... 337/7, 112, 102, 372, 337/380, 381, 46, 48, 49; 29/622, 623

[56] References Cited

U.S. PATENT DOCUMENTS 3,005,075 10/1961 Ellenberger ..... 337/46

3,638,158 1/1972 Thorne ..... 337/49

FOREIGN PATENT DOCUMENTS 1964667 7/1970 Fed. Rep. of Germany ..... 337/48

*Primary Examiner*—Harold Broome

*Attorney, Agent, or Firm*—Werner W. Kleeman

[57] ABSTRACT

Each bimetallic element is associated with one phase and is attached with one end thereof to a metallic support mounted at a wall of a housing. Each support comprises two supporting surfaces or faces lying in a plane which extends at right angles to the bending or deflection direction of the free ends of the bimetallic elements. When all the bimetallic elements have the same temperature, the distance of this plane from the bendable ends of the bimetallic elements is the same for all bimetallic elements. The supports are supported at counter surfaces or faces provided at the housing wall via a plate-shaped intermediate layer of the same thickness. The counter surfaces for all supports lie in a common plane extending at a distance, which corresponds to the thickness of the intermediate layer, from the plane defined by the supporting surfaces and in substantial parallelism thereto. By virtue of the design of the supporting surfaces and the counter surfaces there is ensured that the bendable free ends of all the bimetallic elements which act upon a common slider are aligned with respect to each other after the bimetallic elements have been assembled into the housing. Thus no re-adjustment is necessary.

16 Claims, 3 Drawing Figures

METHOD OF MANUFACTURING A MULTI-PHASE THERMAL CIRCUIT BREAKER AND MULTI-PHASE THERMAL CIRCUIT BREAKER PRODUCED THEREBY

BACKGROUND OF THE INVENTION

The present invention relates to a new and improved method of manufacturing a multi-phase thermal circuit breaker, and to a new and improved multi-phase thermal circuit breaker manufactured thereby.

In its more particular aspects, the method of manufacturing the multi-phase thermal circuit breaker comprises the steps of mounting each of a multiple number of bimetallic elements, each of which contains a bendable section which acts upon a common actuator member, at a support and mounting the supports in juxtaposition to each other at a retainer or holder member.

As to the circuit breaker of the present development such is of the type comprising a multiple number of bimetallic elements, each associated with one phase, and each bimetallic element comprises a bendable section or portion arranged to act upon a common actuator member. Each of the bimetallic elements is mounted at a support which, in turn, is secured to a retainer or holder member.

In multi-phase bimetallic circuit breakers of such type the bimetallic elements each associated with one respective phase act upon a common actuator member which, as a general rule, is designed as a slider. It must be ensured by appropriate measures that all bimetallic elements exert the same effect upon the actuator member when they are heated-up in the same manner. That is to say, the bending sections or portions of all the bimetallic elements must assume the same position relative to the actuator member at a defined ambient temperature and in the absence of current flow through the bimetallic elements.

In a prior art circuit breaker known, for example, from Swiss Pat. No. 558,593 there is measured for this purpose the mutual distances between the freely bendable end portions of the bimetallic elements after the bimetallic elements have been mounted in the housing. On the basis of the thus determined distances an individual slider is manufactured for this particular circuit breaker. Since, in addition to measuring the mentioned distances an individual slider or slide member has to be manufactured for each circuit breaker, this solution is rather expensive in respect of the work involved, something which is disadvantageous in terms of the manufacturing costs even in the case of automated production.

Furthermore, a bimetallic circuit breaker as known, for example, from Swiss Pat. No. 216,532, has bimetallic elements, each of which is secured to a support at one of its ends, and the support is pivotably mounted at a housing. Prior to the installation of the circuit breaker there is adjusted the position of each individual bimetallic element relative to the actuator member, which is designed as a controlling slider, by pivoting the individual supports in such a way that at a defined ambient temperature the distance between the bendable free ends of the bimetallic elements and abutting edges formed at the controlling slider is the same for all the bimetallic elements. This adjustment, which additionally requires some dexterity on the part of the installator, however, is very time-consuming and expensive and is unsuited for an automated manufacturing mode.

A further construction of circuit breaker is known from Swiss Pat. No. 400,319.

SUMMARY OF THE INVENTION

Therefore, with the foregoing in mind it is a primary object of the present invention to provide an improved method of manufacturing a multi-phase thermal circuit breaker which permits an automated manufacturing operation.

Another and more specific object of the present invention aims at the provision of a new and improved method of the aforementioned type which requires the least possible expense and is uncomplicated.

Also, it is a significant object of the present invention to provide a new and improved construction of a multi-phase thermal circuit breaker which may be rationally produced at the smallest possible expense in respect of time and apparatus.

Now in order to implement these and still further objects of the invention, which will become more readily apparent as the description proceeds, the method of the present development is manifested by the features that, after mounting the bimetallic elements at least one supporting face is formed at each one of the supports, the supporting face lying in a plane which extends transversely relative to the bending direction of the bimetallic elements and at a distance from the bendable section which is essentially the same for all supports when the bimetallic elements are in the same heated-up state. Counter surfaces lying in a common plane are provided at a retainer or holder member, and the supports are supportingly connected to the retainer member with the support surfaces being supported at the counter surfaces.

The supporting surfaces can be formed at a predetermined distance from the related bendable section, which is preferably the end portion of the bimetallic elements, in a simple manner and in an automated operation. The same is true for manufacturing the counter surfaces at the retainer or holder member which, for example, may form part of a housing. Since, on the one hand, the distance between each of the bimetallic elements and the supporting surface formed at the associated support or support member is the same for all the bimetallic elements at a given temperature and since, on the other hand, the supports secured to the retainer member are mutually aligned due to their being supported at the counter surfaces which lie in a common plane, the bendable sections or portions of the bimetallic elements also assume a mutually aligned position. Due to the alignment of the bimetallic elements during the course of manufacture re-adjustment is thus no longer required.

As alluded to above, the invention is not only concerned with the aforementioned method aspects, but also relates to a novel construction of a multi-phase thermal circuit breaker. Generally speaking, the inventive circuit breaker comprises supports or support members each of which comprises at least one supporting surface lying in a plane which extends transversely relative to a bending direction of the bimetallic elements and at a distance from the bendable sections of the bimetallic elements which is the same for all supports when said bimetallic elements are in the same heated-up state. Counter surfaces are formed at a retainer or holder member, these counter surfaces lying in a common plane and supporting the supports at the supporting surfaces thereof.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
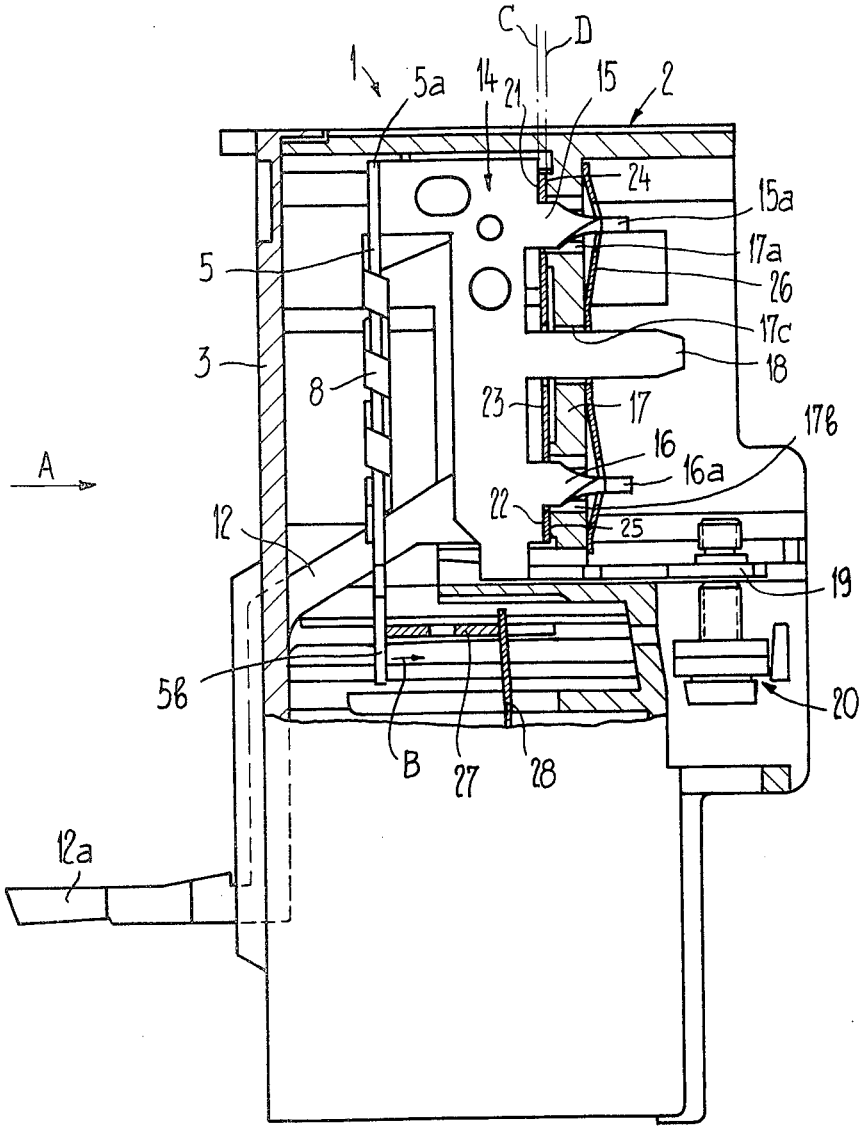
FIG. 1 is a section taken substantially along the line I—I in FIG. 2 of a bimetallic circuit breaker constructed according to the invention.

Describing now the drawings, it is to be understood that only enough of the structure of the multi-phase thermal circuit breaker has been shown as needed for those skilled in the art to readily understand the underlying principles and concepts of the present development. Turning attention now specifically to FIG. 1, there has been illustrated therein a three-phase bimetallic circuit breaker 1 comprising a housing 2 which is provided at one side thereof with a removable cover or cover member 3. Three bimetallic elements 4, 5 and 6 are accommodated in the interior of the housing 2. The bimetallic elements 4, 5 and 6 are arranged in juxtaposition to each other and each is associated with one phase (see FIG. 2). Each of the bimetallic elements 4, 5 and 6 is provided with a heater coil or winding 7, 8 and 9, respectively, one end of which is connected to the associated bimetallic element 4, 5 and 6, respectively, at an attachment spot or location designated by reference numeral 10, and the other end of which is fixed to a connecting element 11, 12 and 13, respectively. The connecting elements 11, 12 and 13 pass through the cover 3 and their free ends 11*a*, 12*a* and 13*a*, respectively, protrude from the housing 2.

Figure 2:
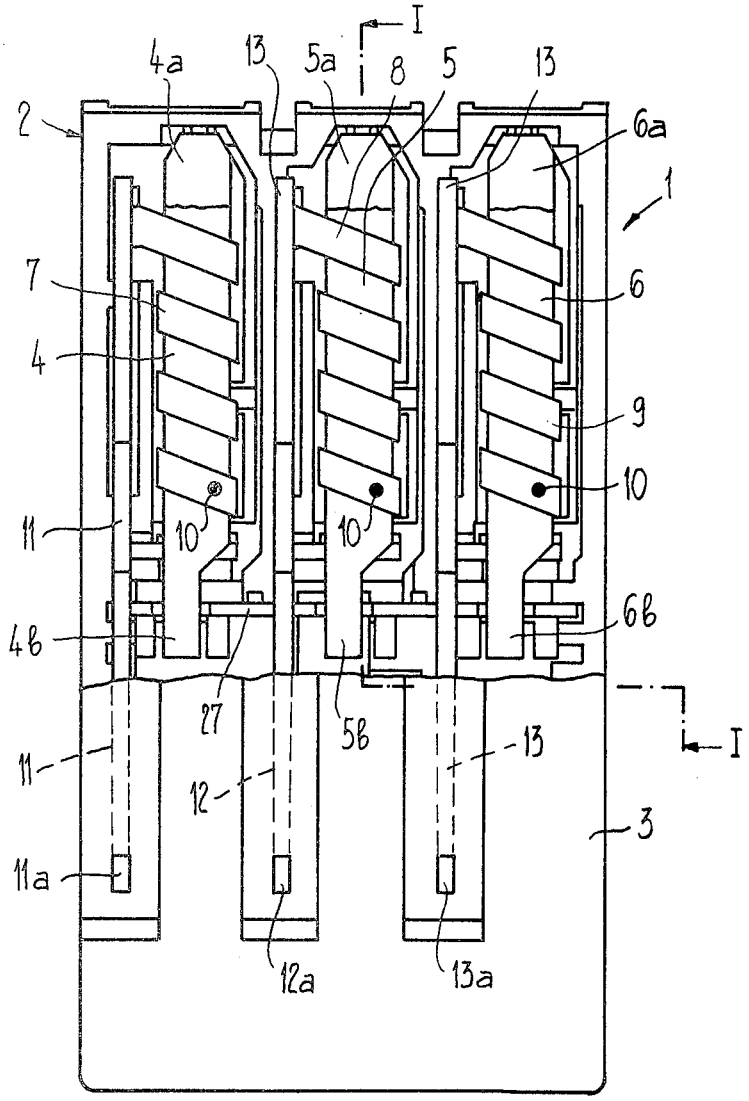
FIG. 2 is a side view, partially cut open of the bimetallic circuit breaker shown in FIG. 1 looking in the direction of the arrow A thereof.
Figure 3:
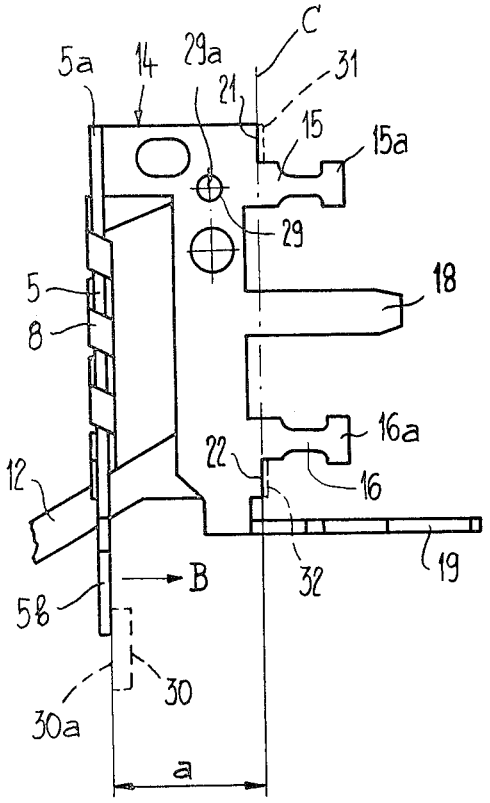
FIG. 3 is a side view of a bimetallic element mounted at a support or support member of the bimetallic circuit breaker shown in FIG. 1.

One end 4*a*, 5*a* and 6*a* of the strip-like designed bimetallic elements 4, 5 and 6, respectively, is fixed to a related metallic support or support member 14, the construction of which will be evident from FIGS. 1 and 3. Each support or support member 14 comprises two protruding attachment or mounting arms 15 and 16 which pass through holes 17*a* and 17*b*, respectively, in a retainer or holder member 17 forming a housing wall. The supports 14 are additionally provided with a connecting member 18 to form a plug connection or junction, and such connecting member 18 extends in parallel to the attachment or mounting arms 15 and 16 and passes through a hole or opening 17*c* in the retainer member 17, so as to be freely accessible from the exterior of the housing 2. Furthermore, each support or support member 14 is provided with a second connecting member 19 to which an electric conductor or line may be connected by means of a terminal 20.

Two supporting surfaces 21 and 22 are provided at each support 14. The supporting surfaces 21 and 22 lie in a common plane which has been indicated by a dash-and-dot line in FIGS. 1 and 3 and which has been designated by reference character C. The plane C extends substantially at right angles to the bending direction B of the bendable sections or portions forming free ends or end portions 4*b*, 5*b* and 6*b* of the bimetallic elements 4, 5 and 6, respectively, mounted at the respective supports 14. Each support or support member 14 contacts a plate-shaped intermediate layer 23 by means of its supporting surfaces 21, 22, the intermediate layer 23 having a uniform thickness at least at the region of the supporting surfaces 21 and 22. On the side opposite to the supporting surfaces 21 and 22 the intermediate layer 23 contacts counter surfaces 24 and 25 formed at the retainer or holder member 17. Also the counter surfaces 24 and 25 lie in a common plane D which has been indicated by dash-and-dot lines in FIG. 1. This plane D also extends at right angles to the aforementioned bending direction B, and thus, is substantially parallel to the plane C.

A backing element 26 having spring or resilient properties is provided for each support 14 at the side of the retainer member 17 which is located opposite to the counter surfaces 24 and 25. The backing element 26 is pierced by the attachment or mounting arms 15 and 16. By twisting the ends or end portions 15*a* and 16*a* of these attachment or mounting arms 15 and 16, respectively, the supports or support members 14 are secured to the retainer or holder member 17 as shown in FIG. 1. The supports 14 and the intermediate layer 23 are urged against the retainer member 17 due to the backing element 26 which is supported at the retainer member 17 and which acts upon the twisted ends or end portions 15*a*, 16*a* of the attachment or mounting arms 15 and 16, respectively, in the manner of a compression or pressure spring. Consequently, the supports 14 which are supported at the counter surfaces 24 and 25, respectively, by means of their supporting surfaces 21 and 22 through the action of the intermediate layer 23 are held in an aligned position. Since the counter surfaces 24 and 25 lie in one and the same plane D for all three supports 14, these three supports 14 are thus, also, mutually aligned.

The bendable sections forming free ends or end portions 4*b*, 5*b* and 6*b* of the bimetallic elements 4, 5 and 6, respectively, bend in the direction of the arrow B when the bimetallic elements 4, 5 and 6 are heated-up. The bendable sections forming such free ends or end portions 4*b*, 5*b* and 6*b* act upon a common slider 27, defining an actuation member, which is journaled in the housing 2 for displacement in the direction of the arrow B. The slider or slide member 27 actuates a lever 28 of a circuit-breaking mechanism which is disposed in the lower portion of the housing 2 and which is not here shown in greater detail. When no electric current flows through the bimetallic elements 4, 5 and 6 and when these bimetallic elements 4, 5 and 6 are at ambient temperature, that is to say, when all of the bimetallic elements are at the same heated-up state, then the bendable sections i.e., the free ends or end portions 4*b*, 5*b* and 6*b* of the bimetallic elements 4, 5 and 6, respectively, are mutually aligned for the reasons already explained and contact the slider 27 as illustrated in FIG. 1.

The aligned state of the bendable sections forming the free end or end portions 4*b*, 5*b* and 6*b* of the bimetallic elements 4, 5 and 6, respectively, is ensured by a corresponding mode of manufacture which will now be considered with reference to FIG. 3 of the drawings:

During a first step of the manufacturing operation the supports or support members 14 are produced with the exception of the supporting surfaces 21 and 22, for example, by performing appropriate punching and bending operations. During this manufacturing operation all supports 14 are provided at the same location with a circular hole 29 having a defined diameter. In the next step of the manufacturing operation the bimetallic elements 4, 5 and 6 already equipped with the heater coils 7, 8 and 9, respectively, and the connecting elements 11, 12 and 13, respectively, are secured at one end 4*a*, 5*a* and 6*a*, respectively, at a related support 14, for example by welding.

The supports or support members 14 are, then, placed on a mandrel or spike or the like by means of their related hole 29 and are pivoted about an axis 29*a* until the bendable sections forming the free ends or end portions 4*b*, 5*b*, and 6*b* of the bimetallic elements 4, 5 and 6, respectively, abut an abutment surface 30*a* of a stationary stop 30 which is indicated by broken lines in FIG. 3. By means of an appropriate tool, such as for instance, a punching tool, operating in a plane C at a fixed distance a from the abutment surface 30*a* of the stationary stop 30 and at right angles to the bending direction B of the bimetallic elements 4, 5 and 6 the supporting surfaces 21 and 22 are now formed at the supports or support members 14. The material sections or portions thus removed are shown in broken lines in FIG. 3 and are designated by reference numerals 31 and 32. The supporting surfaces 21 and 22 lying in this plane C thus possess the aforementioned given distance a from the bendable sections forming the ends or end portions 4*b*, 5*b* and 6*b* of the corresponding bimetallic elements 4, 5 and 6, respectively. Since the same temperature prevails during manufacture of the supporting surfaces 21 and 22, i.e., since all of the bimetallic elements 4, 5 and 6 are in the same heated-up state, the distance a is the same for all of the bimetallic elements 4, 5 and 6. During the next step of the manufacturing operation the supports 14 including the bimetallic elements 4, 5 and 6 are fitted to the housing 2 and secured to the housing wall i.e., the retainer or holder member 17 by twisting the ends or end portions 15*a* and 16*a* of the attachment or mounting arms 15 and 16, respectively. During a preceding step of the operation the counter surfaces 24 and 25 were produced at the housing wall or retainer member 17. As already mentioned heretofore, all of the counter surfaces 24 and 25 provided for the three supports 14 lie in one and the same plane D. Since the supports 14 are urged against the retainer or holder member 17 by the action of the backing element 26 and since the intermediate layers 23 have the same thickness, there is obtained a precise mutual alignment of the three supports 14 when the supports 14 are assembled. Thus the distance between the counter surfaces 24 and 25, that is between the plane D and the bending or bendable sections forming the ends or end portions 4*b*, 5*b* and 6*b* of the bimetallic elements 4, 5 and 6, respectively, is the same for all of the bimetallic elements. Therefore, the bendable sections forming the ends or end portions 4*b*, 5*b* and 6*b* are mutually aligned and capable of acting upon the slider 27 in the same manner when heated-up in the same way. After securing the supports 14 to the housing wall or retainer member 17, therefore, no re-adjustment of the bimetallic elements 4, 5 and 6 is required. The precise placement of the supporting surfaces 21 and 22 at the supports 14 as well as of the counter surfaces 24 and 25 at the retainer member 17 can occur without significant additional expense during the course of the manufacturing process which may be automated without any difficulties. Thus, the expense necessarily connected with re-adjustment work can be beneficially saved.

The circuit breaker 1 as described hereinbefore is connected by means of the terminal or connecting elements 11, 12, 13 and 18 or 19, respectively, into the circuit to be protected. When the bimetallic elements 4, 5 and 6 are heated-up, the bendable sections forming the respective ends or end portions 4*b*, 5*b* and 6*b*, thereof will bend in the direction of the arrow B and effect a displacement of the slider 27 which, in turn, acts upon the lever 28. When the latter is pivoted to a certain extent, the circuit-breaking mechanism will respond in conventional manner.

While there are shown and described present preferred embodiments of the invention, it is to be distinctly understood that the invention is not limited thereto, but may be otherwise variously embodied and practiced within the scope of the following claims. Accordingly,

What we claim is:

1. A method of manufacturing a multi-phase thermal circuit breaker, comprising the steps of:

mounting upon a related support each of a plurality of bimetallic elements, each of which comprises a bendable section capable of acting upon a common actuator member;

forming at least one supporting surface at each of said supports;

said at least one supporting surface lying in a plane which extends transversely relative to a predetermined direction of bending of said bimetallic elements and being spaced at a distance from said bendable section which is essentially the same for all of the supports when said bimetallic elements are in the same heated-up state;

providing a retainer member having counter surfaces lying in a common plane; and supportingly connecting said supports in juxtaposition to each other with said retainer member and with said support surfaces being supported at said counter surfaces.

2. The method as defined in claim 1, further including the steps of:

forming said supporting surfaces and said counter surfaces so as to lie in planes extending substantially at right angles to said bending direction of said bimetallic elements.

3. The method as defined in claim 1, further including the steps of:

directly placing said supporting surfaces into contact with said counter surfaces.

4. The method as defined in claim 1, further including the steps of:

indirectly contacting said supporting surfaces with said counter surfaces by interposing therebetween an intermediate layer.

5. The method as defined in claim 1, further including the steps of:

positioning said supports, after mounting the bimetallic elements thereon, so as to have said bendable sections of said bimetallic elements contact a stop; and forming said supporting surfaces at a predetermined distance from said stop.

6. The method as defined in claim 5, wherein:

the step of positioning said supports entails pivoting the supports into a position contacting said stop.

7. The method as defined in claim 1, further including the steps of:

arranging at least one resilient element between said retaining member and said supports in order to urge the supports against said retainer member.

8. The method as defined in claim 1, further including the steps of:

securing said supports to said retainer member by twisting an end portion of at least one attachment member formed at each said support and passing through said retainer member.

9. The method as defined in claim 8, further including the steps of:

arranging a resilient element between said retainer member and said twisted end portion.

10. A multi-phase thermal circuit breaker comprising:

a plurality of bimetallic elements each operatively associated with one phase;

each said bimetallic element comprising a bendable section arranged to act upon a common actuator member;

a number of supports at each of which there is mounted a respective one of said bimetallic elements;

each said support comprising at least one supporting surface lying in a plane which extends transversely relative to a predetermined direction of bending of said bimetallic elements and at a distance from said bendable section of said bimetallic elements which is essentially the same for all supports when said bimetallic elements are essentially in the same heated-up state;

a retainer member to which said supports are secured;

said retainer member being provided with counter surfaces; and said counter surfaces lying in a common plane and supporting said supports at said supporting surfaces.

11. The circuit breaker as defined in claim 10, wherein:

said supporting surfaces and said counter surfaces each lie in a respective plane which extend substantially at right angles to the predetermined bending direction of said bimetallic elements.

12. The circuit breaker as defined in claim 10, wherein:

said supporting surfaces directly bear upon said counter surfaces.

13. The circuit breaker as defined in claim 10, further including:

an intermediate layer interposed between said supporting surfaces and said counter surfaces.

14. The circuit breaker as defined in claim 10, further including:

at least one resilient element disposed between said supports and said retainer member in order to urge said supports towards said retainer member.

15. The circuit breaker as defined in claim 10, wherein:

each of said supports contain at least one attachment member passing through said retainer member; and said attachment member including a twisted end portion for securing each related support to said retainer member.

16. The circuit breaker as defined in claim 15, further including:

at least one resilient element arranged between said retainer member and said twisted end portion of said attachment member.

* * * * *